US008793954B2

(12) United States Patent
Stanchfield

(10) Patent No.: US 8,793,954 B2
(45) **Date of Patent: *Aug. 5, 2014**

(54) TRANSITION MOLDING

(71) Applicant: Pergo (Europe) AB, Trelleborg (SE)

(72) Inventor: Oliver Stanchfield, Raleigh, NC (US)

(73) Assignee: Pergo (Europe) AB, Trelleborg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 13/709,979

(22) Filed: Dec. 10, 2012

(65) Prior Publication Data

US 2013/0167464 A1 Jul. 4, 2013

Related U.S. Application Data

(60) Continuation of application No. 11/785,176, filed on Apr. 16, 2007, now Pat. No. 8,327,595, which is a division of application No. 11/034,941, filed on Jan. 14, 2005, now Pat. No. 7,640,706, which is a division of application No. 10/347,489, filed on Jan. 21, 2003, now Pat. No. 6,860,074, which is a continuation of application No. 09/986,414, filed on Nov. 8, 2001, now abandoned.

(51) Int. Cl.

| | |
|---|---|
| ***E04B 2/00*** | (2006.01) |
| ***E04D 1/36*** | (2006.01) |
| ***E04F 15/14*** | (2006.01) |

(52) U.S. Cl.

USPC ..... 52/464; 52/287.1; 52/459; 52/468

(58) Field of Classification Search

CPC ..... E04F 19/062; E04F 19/066; E04F 19/063; E04F 19/061; E04B 1/6803; E04B 1/6804

USPC ..... 52/98, 100, 489, 464, 466, 468, 287.1, 52/288.1, 716.8, 312, 470–472, 179

See application file for complete search history.

(56) References Cited

U.S. PATENT DOCUMENTS 606,532 A * 6/1898 Furness ..... 52/179
1,357,713 A 11/1920 Lane (Continued)

FOREIGN PATENT DOCUMENTS

| | | |
|---|---|---|
| BE | 1010487 | 10/1998 |
| CA | 991373 | 6/1976 |

(Continued)

OTHER PUBLICATIONS

Encyclopedia of Chemical Technology, 3rd Edition, vol. 23, "Thyroid and Antithyroid Preparations to Vinyl Polymers", 1983, John Wiley & Sons; USA.

(Continued)

*Primary Examiner* — Elizabeth A Plummer

(74) *Attorney, Agent, or Firm* — Jenkins, Wilson, Taylor & Hunt, P.A.

(57) ABSTRACT

The invention is a joint cover assembly for covering a gap adjacent an edge of a panel that covers a sub-surface, and a method of covering such a gap. The assembly includes a molding having a foot, a first arm, and a second arm. The foot is positioned along a longitudinal axis, and the first arm extends generally perpendicularly from the foot. The second arm extends generally perpendicularly from the foot. A tab depends generally perpendicularly from the first panel engaging surface. At least one of the tab and the foot engage the edge in order to tightly fit within the gap. The method includes the steps of placing the foot in the gap, pressing the respective panel engaging surfaces into contact with respective panels, and configuring at least one of the tab and the foot to cooperate to retain the molding in the gap when the assembly is in an installed condition.

11 Claims, 6 Drawing Sheets

(56) References Cited

U.S. PATENT DOCUMENTS 1,576,527 A 3/1926 McBride
1,736,539 A 11/1929 Lachman
1,942,137 A 1/1934 Connell et al.
1,966,020 A 7/1934 Rowley
2,100,238 A 11/1937 Burgess
2,194,086 A 3/1940 Horn
2,363,429 A 11/1944 Lowry
2,796,624 A 6/1957 Speer
2,926,401 A 3/1960 Place
2,996,751 A 8/1961 Rody et al.
3,028,938 A 4/1962 Wallace
3,162,906 A 12/1964 Dudley
3,199,258 A 8/1965 Jentoft
3,286,425 A 11/1966 Brown
3,296,056 A 1/1967 Bechtold
3,331,171 A 7/1967 Hallock
3,339,329 A 9/1967 Berg
3,362,127 A 1/1968 McGowan
3,363,381 A 1/1968 Forrest
3,363,382 A 1/1968 Forrest
3,411,977 A 11/1968 Slater, Jr.
3,435,574 A 4/1969 Hallock
3,488,828 A 1/1970 Gallagher
3,508,369 A 4/1970 Tennison
3,543,326 A 12/1970 Rohrberg
3,568,386 A * 3/1971 Gossen ..... 52/288.1
3,570,205 A 3/1971 Payne
3,665,666 A 5/1972 Delcroix
3,667,177 A 6/1972 Biela
3,670,470 A 6/1972 Thom
3,671,369 A 6/1972 Kvalheim
3,696,461 A 10/1972 Kelly
3,696,575 A 10/1972 Armstrong
3,745,726 A 7/1973 Thom
3,758,650 A 9/1973 Hurst
3,760,544 A 9/1973 Hawes
3,810,707 A 5/1974 Tungseth
3,953,661 A 4/1976 Gulley
D240,221 S 6/1976 Hinze
4,059,933 A 11/1977 Funk
4,067,155 A 1/1978 Ruff
4,198,455 A 4/1980 Spiro et al.
4,244,102 A 1/1981 Bolles
4,292,774 A 10/1981 Mairle
4,445,306 A 5/1984 Schauffele
4,455,803 A 6/1984 Kornberger
4,461,131 A 7/1984 Pressell
4,474,197 A 10/1984 Kinoshita
4,504,347 A 3/1985 Munk et al.
4,520,062 A 5/1985 Ungar
4,594,347 A 6/1986 Ishikawa
4,643,237 A 2/1987 Rosa
4,653,138 A 3/1987 Carder
4,736,563 A 4/1988 Bilhorn
4,747,197 A 5/1988 Charron
4,757,657 A 7/1988 Mitchell
4,806,435 A 2/1989 Athey
4,833,956 A 5/1989 Roberts
4,893,449 A 1/1990 Kemper
4,905,431 A 3/1990 Davis
4,940,503 A 7/1990 Lindgren
5,034,272 A 7/1991 Lindgren
5,074,089 A 12/1991 Kemmer et al.
5,155,952 A 10/1992 Herwegh et al.
5,288,540 A 2/1994 Albrinck et al.
5,365,713 A 11/1994 Nicholas
5,451,451 A 9/1995 Minnick
5,469,666 A 11/1995 Lewis, Jr.
D373,203 S 8/1996 Kornfalt
5,581,967 A 12/1996 Glatz
5,638,653 A 6/1997 Rossi
5,653,072 A 8/1997 Seelandt-Stasek et al.
5,657,598 A 8/1997 Wilbs et al.
5,688,569 A 11/1997 Gilmore
5,695,875 A 12/1997 Larsson
5,706,623 A 1/1998 Brown
5,769,562 A 6/1998 Jones
5,888,017 A 3/1999 Corrie
5,937,612 A 8/1999 Winer et al.
5,939,670 A 8/1999 Shteynberg et al.
6,073,408 A 6/2000 Winer et al.
6,093,473 A 7/2000 Min
6,115,975 A 9/2000 Abdollahi
6,134,854 A 10/2000 Stanchfield
6,141,920 A 11/2000 Kemper
6,148,584 A 11/2000 Wilson
6,158,915 A 12/2000 Kise
6,219,982 B1 4/2001 Eyring
6,230,385 B1 5/2001 Nelson
6,230,410 B1 5/2001 Taylor et al.
6,253,514 B1 7/2001 Jobe
6,298,561 B1 10/2001 Decker
6,345,480 B1 2/2002 Kemper et al.
6,360,500 B1 3/2002 Wilcox
6,421,970 B1 7/2002 Martensson et al.
6,517,935 B1 2/2003 Kornfalt et al.
6,536,178 B1 3/2003 Palsson et al.
6,550,192 B1 4/2003 Nelson et al.
6,550,205 B2 4/2003 Neuhofer, Jr.
6,560,944 B1 5/2003 Wilson
6,588,165 B1 7/2003 Wright
6,591,568 B1 7/2003 Palsson
6,606,827 B1 8/2003 Hoffmann
6,647,680 B2 11/2003 Daly et al.
D490,167 S 5/2004 Eichner et al.
6,745,534 B2 6/2004 Kornfalt
6,805,951 B2 10/2004 Kornfalt et al.
6,823,638 B2 11/2004 Stanchfield
6,860,047 B1 3/2005 Rodriguez
6,860,074 B2 3/2005 Stanchfield
D504,181 S 4/2005 Stanchfield
D504,730 S 5/2005 Kornfalt et al.
D504,731 S 5/2005 Stanchfield
D505,211 S 5/2005 Stanchfield
6,898,911 B2 5/2005 Kornfalt
6,964,075 B1 11/2005 Iannacone, Jr.
6,988,345 B1 1/2006 Pelfrey et al.
6,991,830 B1 1/2006 Hansson
7,003,364 B1 2/2006 Hansson
7,029,741 B2 4/2006 Sjoberg
7,037,024 B2 5/2006 Steinwender
7,065,931 B2 6/2006 Kornfalt
7,091,579 B2 8/2006 Nemoto
7,150,134 B2 12/2006 Kornfalt et al.
7,188,456 B2 3/2007 Knauseder
7,207,143 B2 4/2007 Stanchfield
D542,939 S 5/2007 Neuhofer, Jr.
D542,941 S 5/2007 Neuhofer, Jr.
7,287,357 B2 10/2007 Gomez
D562,466 S 2/2008 Visintin
7,389,613 B2 6/2008 Sondermann
7,441,384 B2 10/2008 Miller
7,476,351 B2 1/2009 Nilsson
7,559,177 B2 * 7/2009 Stanchfield ..... 52/459
7,640,705 B2 1/2010 Kornfalt et al.
7,640,706 B2 1/2010 Stanchfield
7,644,553 B2 1/2010 Knauseder
7,735,283 B2 6/2010 Stanchfield
7,784,237 B2 8/2010 Stanchfield
7,793,483 B2 9/2010 Stanchfield et al.
7,814,720 B2 10/2010 Neuhofer
7,820,287 B2 10/2010 Kornfalt et al.
7,862,670 B2 1/2011 Hansson
7,908,819 B2 3/2011 Neuhofer, Jr.
8,122,665 B2 2/2012 Stanchfield et al.
8,205,410 B2 6/2012 Stanchfield
8,286,403 B2 * 10/2012 Schacht et al. ..... 52/717.04
8,327,595 B2 12/2012 Stanchfield
8,448,399 B2 5/2013 Kornfalt
8,484,919 B2 7/2013 Brunedal
8,528,285 B2 9/2013 Kornfalt
8,539,731 B2 9/2013 Stanchfield
2001/0037617 A1 11/2001 Chi
2002/0025446 A1 2/2002 Chen et al.

(56) References Cited

U.S. PATENT DOCUMENTS

| | | | | |
|---|---|---|---|---|
| 2002/0108323 | A1 | 8/2002 | Gruber | |
| 2002/0127374 | A1 | 9/2002 | Spratling | |
| 2003/0084634 | A1 | 5/2003 | Stanchfield | |
| 2003/0141004 | A1 | 7/2003 | Palmblad et al. | |
| 2003/0207083 | A1 | 11/2003 | Hansson et al. | |
| 2005/0166526 | A1 | 8/2005 | Stanchfield | |
| 2007/0107344 | A1 | 5/2007 | Kornfalt et al. | |
| 2007/0125021 | A1 | 6/2007 | Theirs et al. | |
| 2007/0283654 | A1 | 12/2007 | Stanchfield et al. | |
| 2008/0034696 | A1 | 2/2008 | Neuhofer | |
| 2008/0168729 | A1 | 7/2008 | Brunedal | |
| 2008/0263983 | A1 | 10/2008 | Stanchfield et al. | |
| 2009/0266021 | A1* | 10/2009 | Neuhofer, Jr. | 52/468 |
| 2010/0242393 | A1 | 9/2010 | Kornfalt | |
| 2012/0272602 | A1 | 11/2012 | Stanchfield et al. | |
| 2012/0324817 | A1 | 12/2012 | Stanchfield | |

FOREIGN PATENT DOCUMENTS

| | | |
|---|---|---|
| DE | 2159042 | 11/1971 |
| DE | 2238660 | 2/1974 |
| DE | 2502992 | 1/1975 |
| DE | 2638518 | 3/1977 |
| DE | 3041781 | 6/1982 |
| DE | 3343601 | 2/1983 |
| DE | 3544845 | 6/1987 |
| DE | 3640822 | 6/1988 |
| DE | 3932980 | 3/1989 |
| DE | 29600057 | 4/1996 |
| DE | 29618803 | 2/1997 |
| DE | 29703962 | 4/1997 |
| DE | 19951516 | 10/1999 |
| DE | 19821938 | 11/1999 |
| DE | 29920645 | 3/2000 |
| DE | 20100413 | 4/2002 |
| DE | 10131248 | 1/2003 |
| EP | 1111155 | 12/1999 |
| EP | 0788576 | 9/2000 |
| EP | 1310613 | 5/2003 |
| FR | 2 268 922 | 11/1975 |
| GB | 424057 | 2/1935 |
| GB | 812671 | 4/1959 |
| GB | 1348272 | 4/1971 |
| GB | 1430423 | 5/1974 |
| GB | 2088280 | 6/1982 |
| GB | 2096665 | 10/1982 |
| GB | 2117813 | 10/1983 |
| GB | 2141457 | 12/1984 |
| GB | 2256023 | 11/1992 |
| JP | 3169967 | 7/1991 |
| SE | 467150 | 6/1992 |
| SE | 501014 | 10/1994 |
| SE | 502994 | 3/1996 |
| SE | 503861 | 9/1996 |
| SE | 9904533 | 6/2001 |
| SE | 517363 | 5/2002 |
| WO | WO 93/13280 | 7/1993 |
| WO | WO 94/01628 | 1/1994 |
| WO | WO 94/26999 | 11/1994 |
| WO | WO 9612857 | 5/1996 |
| WO | WO 96/27719 | 9/1996 |
| WO | WO 9731775 | 9/1997 |
| WO | WO 9731776 | 9/1997 |
| WO | WO 9822678 | 5/1998 |
| WO | WO 99/01628 | 1/1999 |
| WO | WO 99/66151 | 12/1999 |
| WO | WO 0014351 | 3/2000 |
| WO | WO 01/20101 | 3/2001 |
| WO | WO 0131141 | 5/2001 |
| WO | WO 01/42589 | 6/2001 |
| WO | WO 0240809 | 5/2002 |
| WO | WO 03/016657 | 2/2003 |
| WO | WO 03040492 | 5/2003 |
| WO | WO 03093686 | 11/2003 |
| WO | WO 2005/049938 | 6/2005 |
| WO | WO 2005/059269 | 6/2005 |
| WO | WO 2005/065381 | 7/2005 |
| WO | WO 2005/083195 | 9/2005 |
| WO | WO 2005/083196 | 9/2005 |
| WO | WO 2005/116364 | 12/2005 |
| WO | WO 2005/122667 | 12/2005 |
| WO | WO 2006/093866 | 9/2006 |

OTHER PUBLICATIONS

Sweets Catalog File, Products for General Building and Renovation; McGraw Hill Information Systems Co.; Feb. 1986, pp. 18-19.
Time Life Catalog;pp. 1-35; 1994.
"Wood Flooring," Floors, Stairs & Carpets, Time Life Books , Inc., Jan. 1994, p. 14.
Fix it Yourself, Floors, Stairs, & Carpets. Time Life Books, St. Remy Press, ISBN0-376-01909-3, pp. 14-35, Jan. 1994.
Vila, Bob, Bob Vila's Workshop: The Ultimate Illustrated Handbook for the Home Workshop, William Morrow and Company, Inc., published Oct. 5, 1994, pp. 107-112.
Magazin Parkett; Feb. 1995.
International Search Report of PCT/SE95/01206 dated Nov. 21, 1995.
Marcarena Flooring; Formica Corporation 1998.
Final Office Action for U.S. Appl. No. 08/817,391 dated Jul. 8, 1998.
Examiner Interview Summary for U.S. Appl. No. 08/817,391 dated Dec. 9, 1998.
Formica Flooring Catalog; Formica Corporation 1999.
Pergo Original Catalog, Jan. 1999.
Notice of Allowance for U.S. Appl. No. 08/817,391 dated Nov. 6, 2002.
Search Report for PCT/IB02/04737 dated Dec. 3, 2003.
Non-final Office Action for U.S. Appl. No. 10/347,489 dated Feb. 18, 2004.
Non-final Office Action for U.S. Appl. No. 10/748,852 dated Feb. 18, 2004.
Non-Final Office Action for U.S. Appl. No. 10/319,820 dated Mar. 25, 2004.
Notice of Allowance for U.S. Appl. No. 10/360,802 dated Jul. 16, 2004.
Examiner Interview Summary for U.S. Appl. No. 10/360,802 dated Jul. 16, 2004.
Final Office Action for U.S. Appl. No. 10/319,820 dated Jul. 26, 2004.
Notice of Allowance for U.S. Appl. No. 10/347,489 dated Aug. 23, 2004.
Notice of Allowance for U.S. Appl. No. 10/748,852 dated Aug. 23, 2004.
Notice of Allowance for U.S. Appl. No. 10/319,820 dated Nov. 4, 2004.
Notice of Allowance for U.S. Appl. No. 29/208,500 dated Dec. 2, 2004.
Supplemental Notice of Allowance for U.S. Appl. No. 10/319,820 dated Mar. 9, 2005.
Non-Final Office Action for U.S. Appl. No. 10/902,062 dated Apr. 5, 2005.
Final Office Action for U.S. Appl. No. 10/902,062 dated Nov. 28, 2005.
Notice of Allowance for U.S. Appl. No. 10/902,062 dated Mar. 15, 2006.
Non-Final Office Action for U.S. Appl. No. 11/140,075 dated Apr. 28, 2006.
Non-final Office Action for U.S. Appl. No. 11/343,199 Jul. 10, 2006.
Search Report Dated Aug. 9, 2006.
International Search Report dated Aug. 22, 2006.
Notice of Allowance for U.S. Appl. No. 11/140,075 dated Sep. 14, 2006.
Notice of Allowance for U.S. Appl. No. 11/343,199 dated Dec. 14, 2006.
Non-Final Office Action for U.S. Appl. No. 11/640,351 dated Jun. 26, 2007.
Non-Final Office Action for U.S. Appl. No. 11/785,176 dated Sep. 17, 2007.

(56) References Cited

OTHER PUBLICATIONS

Final Office Action for U.S. Appl. No. 11/640,351 dated Dec. 13, 2007.
Non-Final Office Action for U.S. Appl. No. 11/785,176 dated Mar. 26, 2008.
Non-Final Office Action for U.S. Appl. No. 11/907,965 dated Jun. 23, 2008.
Non-final Office Action for U.S. Appl. No. 11/785,174 dated Jul. 10, 2008.
Examiner Interview Summary for U.S. Appl. No. 11/640,351 dated Jul. 23, 2008.
Non-Final Office Action for U.S. Appl. No. 11/640,351 dated Aug. 12, 2008.
Non-final Office Action for U.S. Appl. No. 11/066,099 dated Sep. 15, 2008.
Non-Final Office Action for U.S. Appl. No. 10/895,329 dated Oct. 8, 2008.
Final Office Action for U.S. Appl. No. 11/785,176 dated Nov. 10, 2008.
International Search Report, Nov. 10, 2008.
Final Office Action for U.S. Appl. No. 11/907,965 dated Dec. 11, 2008.
Final Office Action for U.S. Appl. No. 11/066,099 dated Apr. 14, 2009.
Final Office Action for U.S. Appl. No. 11/640,351 dated Apr. 22, 2009.
Non-Final Office Action for U.S. Appl. No. 11/400,519 dated Apr. 24, 2009.
Non-Final Office Action for U.S. Appl. No. 11/785,176 dated May 28, 2009.
Advisory Action for U.S. Appl. No. 11/066,099 dated Aug. 14, 2009.
Notice of Allowance for U.S. Appl. No. 11/400,519 dated Aug. 24, 2009.
Final Office Action for U.S. Appl. No. 10/895,329 dated Sep. 16, 2009.
Final Office Action for U.S. Appl. No. 11/785,174 dated Oct. 28, 2009.
Non-Final Office Action for U.S. Appl. No. 11/785,176 dated Nov. 24, 2009.
Notice of Allowance for U.S. Appl. No. 11/785,174 dated Feb. 16, 2010.
Notice of Allowance for U.S. Appl. No. 11/066,099 dated Feb. 18, 2010.
Notice of Allowance for U.S. Appl. No. 10/895,329 dated Jun. 25, 2010.
Non-Final Office Action for U.S. Appl. No. 11/785,176 dated Jun. 29, 2010.
Non-Final Office Action for U.S. Appl. No. 11/984,091 dated Jul. 7, 2010.
Office Action/Restriction Requirement for U.S. Appl. No. 12/787,199 dated Oct. 25, 2010.
Supplemental European Search Report dated Nov. 19, 2010.
Final Office Action for U.S. Appl. No. 11/984,091 dated Nov. 23, 2010.
Non-Final Office Action for U.S. Appl. No. 11/785,176 dated Jan. 6, 2012.
Final Office Action for U.S. Appl. No. 11/785,176 dated Jan. 20, 2011.
Non-final Office Action for U.S. Appl. No. 12/787,199 dated Jan. 21, 2011.
Notice of Allowance for U.S. Appl. No. 12/787,199 dated Feb. 27, 2012.
Non-Final Office Action for U.S. Appl. No. 12/731,645 dated Mar. 27, 2012.
Examination Report for European Application Serial No. EP 04815942 dated Apr. 23, 2012.
Non-Final Office Action for U.S. Appl. No. 11/907,965 dated Jun. 27, 2012.
Examiner Interview Summary for U.S. Appl. No. 11/785,176 dated Jul. 2, 2012.
Notice of Allowance for U.S. Appl. No. 11/785,176 dated Aug. 6, 2012.
Final Office Action for U.S. Appl. No. 12/731,645 dated Aug. 24, 2012.
Final Office Action for U.S. Appl. No. 11/907,965 dated Nov. 8, 2012.
Non-Final Office Action for U.S. Appl. No. 13/532,590 dated Nov. 28, 2012.
Non-Final Office Action for U.S. Appl. No. 12/731,645 dated Dec. 4, 2012.
Notice of Allowance for U.S. Appl. No. 11/907,965 dated Jan. 23, 2013.
Non-Final Office Action for U.S. Appl. No. 13/532,590 dated Jan. 25, 2013.
Notice of Allowance for U.S. Appl. No. 11/640,351 dated Feb. 4, 2013.
Bob Vila's Workshop—The Ultimate Illustrated Handbook for the Home Workshop, Bob Vila.
B.S. Bauprogram Handelsgesellschaft mbH Catalog.
Ceiling Program.
Decades Laminate Flooring.
Faus Group Catalog.
FN Neuhofer Holz, "Profiles in Various Kinds and Innovative Accessories," Certified according to DIN EN IS 9002 (Neuhofer Holz Catalog).
German Search Report.
Haro Wand und Decke (Haro Catalog).
Meister Panels; Meister-Listen Schulte GmbH.
Original Pergo the Free and Easy Floor (Pergo Catalog).
Pergo Original Catalog.
Reexamination No. 90/007,365.
Reexamination No. 90/007,526.
Reexamination No. 90/007,366.
Search Report for PCT/US04/43953.
Time Life Books; "Floors, Stairs, Carpets", p. 14.
"Wohnkultur-von der Natur gestaltet" (Haro Catalog).
Corrected Ex Parte Request for Reexamination for U.S. Appl. No. 90/012,793 dated Mar. 22, 2013.
Examiner Interview Summary for U.S. Appl. No. 90/012,793 dated Apr. 3, 2013.
Notice of Assignment for U.S. Appl. No. 90/012,793 dated Apr. 4, 2013.
Decision Granting Request for Ex Parte Reexamination for U.S. Appl. No. 90/012,793 dated May 10, 2013.
Ex Parte Reexamination Request for U.S. Appl. No. 90/012,923 dated Jul. 23, 2013.
Notice of Assignment for U.S. Appl. No. 90/012,923 dated Aug. 2, 2013.
Ex Parte Reexamination Request for U.S. Appl. No. 90/012,942 dated Aug. 5, 2013.
Examiner Interview Summary for U.S. Appl. No. 90/012,923 dated Aug. 9, 2013.
Notice of Assignment for U.S. Appl. No. 90/012,942 dated Aug. 20, 2013.
Decision Granting Request for Ex Parte Reexamination for U.S. Appl. No. 90/012,942 dated Sep. 4, 2013.
Restriction Requirement for U.S. Appl. No. 13/406,125 dated Feb. 8, 2013.
Notice of Allowance for U.S. Appl. No. 11/907,965 dated Mar. 11, 2013.
Notice of Allowance for U.S. Appl. No. 12/731,645 dated May 9, 2013.
Notice of Allowance for U.S. Appl. No. 13/532,590 dated May 20, 2013.
Restriction Requirement for U.S. Appl. No. 13/457,111 dated Jun. 14, 2013.
Notice of Allowance for U.S. Appl. No. 29/419,293 dated Jun. 19, 2013.
Corrected Notice of Allowance for U.S. Appl. No. 13/532,590 dated Jul. 29, 2013.

* cited by examiner

TRANSITION MOLDING

This application is a continuation of U.S. patent application Ser. No. 11/785,176, filed Apr. 16, 2007, now U.S. Pat. No. 8,327,595, which is a divisional application of U.S. patent application Ser. No. 11/034,941, filed Jan. 14, 2005, now U.S. Pat. No. 7,640,706, which is a divisional application of U.S. patent application Ser. No. 10/347,489, filed Jan. 21, 2003, now U.S. Pat. No. 6,860,074, which is a continuation-in-part application of U.S. patent application Ser. No. 09/986,414, filed Nov. 8, 2001 (now abandoned), the entire disclosures of which are incorporated herein by reference.

BACKGROUND

1. Field of the Invention

The invention is a joint cover assembly that includes a molding, similar to a T-Molding, for covering a gap that may be formed adjacent a panel in a generally planar surface, such as between two adjacent flooring materials, a floor and a wall, or a riser and a runner in a step (or a series of steps).

2. Background of the Invention

Wood or laminate flooring has become increasingly popular. As such, many different types of this flooring have been developed. Generally, this type of flooring is assembled by providing a plurality of similar panels. The differing types of panels that have developed, of course, may have differing depths and thicknesses. Thus, when panels having different thicknesses are placed adjacent to each other, transition moldings are often used to create a smooth joint.

Additionally, one may desire to install floor panels adjacent to an area with different types of material. For example, one may desire to have one type of flooring in a kitchen (e.g., laminate flooring or ceramic tile), and a different appearance in an adjacent living room (e.g., linoleum or carpeting), and an entirely different look in an adjacent bath. Therefore, it has become necessary to develop a type of molding or seal that could be used as a transition from one type of flooring to another.

A problem is encountered, however, when flooring materials that are dissimilar in shape or texture are used. For example, when a hard floor is placed adjacent a carpet, problems are encountered with conventional edge moldings placed there between. Such problems include difficulty in covering the gap that may be formed between the floorings having different height or thickness.

Moreover, for purposes of reducing cost, it is important to be able to have a molding that is versatile, having the ability to cover gaps between relatively coplanar surfaces, as well as surfaces of differing thicknesses.

It would also be of benefit to reduce the number of molding profiles that need to be kept in inventory by a seller or installer of laminate flooring. Thus, the invention also provides a method by which the number of moldings can be reduced while still providing all the functions necessary of transition moldings.

SUMMARY OF THE INVENTION

The invention is a joint cover assembly for covering a gap between edges of adjacent floor elements, such as panels. The assembly includes a body having a foot positioned along a longitudinal axis, and a first arm extending generally perpendicularly from the foot. The assembly may include a second arm also extending generally perpendicular to the foot. A tab may additionally be provided on either the first or second arms, displaced from the foot, extending perpendicularly from the arm.

The assembly is preferably provided with a securing means to prevent the assembly from moving once assembled. In one embodiment, the securing means is a clamp, designed to grab the foot. Preferably, the clamp includes a groove into which the foot is inserted. In a preferred embodiment a rail may be joined directly to a subsurface below the floor element, such as a subfloor, by any conventional means, such as, a nail, screw or adhesive.

The outward-facing surface of the assembly may be formed as a single, unitary, monolithic surface that covers both the first and second arms. This outward-facing surface may be treated, for example, with a laminate or a paper, such as a decor, impregnated with a resin, in order to increase its aesthetic value, or blend, to match or contrast with the panels.

A shim may also be placed between the foot and the subfloor. In one embodiment, the shim may be positioned on the underside of the clamp; however, if a clamp is not used, the shim may be positioned between the foot and the subfloor. The shim may be adhered to either the foot or subfloor using an adhesive or a conventional fastener, e.g., nail or screw.

The assembly may also include a leveling block positioned between the first arm and the adjacent panel. The leveling block generally has an upper surface that engages the arm, and a bottom that abuts against the adjacent panel. In a preferred embodiment, the leveling block has a channel formed in upper surface, configured to receive the tab on the arm. The particular size of leveling block is chosen, conforming essentially to the difference in thicknesses between the first and second panels. The exposed surfaces of the leveling block is typically formed from a variety of materials, such as a carpet, laminate flooring, ceramic or wood tile, linoleum, turf, paper, natural wood or veneer, vinyl, wood, ceramic or composite finish, or any type of covering, while the interior of the leveling block is generally formed from a wood or other structural material. The leveling block additionally facilitates the use of floor coverings having varying thicknesses when covering a subfloor. The leveling block helps the molding not only cover the gap, but provide a smoother transition from one surface to another.

Alternatively, the tab may be positioned to slidingly engage the edge of a panel when no leveling block is used. A lip may additionally be positioned on the tab in order to slidingly engage a protuberance, adjacent an upper edge of the clamp in order to retain the assembly in its installed position.

The tab is preferably shaped as to provide forces to maintain the assembly in the installed position. Thus, typically the tab may be frustum-shaped, with its narrow edge closest to the arm and the wider edge furthest from the arm. Additionally, the tab may be lobe shaped, having a bulbous end furthest from the arm. Of course, any suitable shape is sufficient, as long as the tab can provide enough resistive forces to hinder removal of the installed assembly. By forming a corresponding channel in the leveling block (or in the upper surface of the flooring element), the tab can help to secure the assembly in place.

The assembly may additionally be used to cover gaps between tongue-and-groove type panels, such as glueless laminate floor panels. In addition to the uses mentioned above, the tab may also be designed to mate with a corresponding channel in the panel the edge of one of the flooring elements, or may actually fit within a grooved edge. In order to better accommodate this type of gap, a second tab may be positioned to depend from the second panel engaging surface.

An adhesive, such as a glue, a microballoon adhesive, contact adhesive, or chemically activated adhesive including a water-activated adhesive, may be positioned on the tab, the foot, and the arms. Of course, such an adhesive is not necessary, but may enhance or supplement the snap-type fit of the assembly into the gap between the floor elements. Additionally, the adhesive may assist in creating a more air-tight or moisture-tight joint.

The assembly may be used in other non-coplanar areas, such as the edge between a wall and a floor, or even on stairs. For example, the assembly may include, the first and second arms, and foot as described above, but instead of transitioning between two floor elements placed in the same plane, may form the joint between the horizontal and vertical surfaces of a single stair element.

The inventive assembly may be used for positioning between adjacent tongue-and-groove panels; in this regard, the assembly functions as a transition molding, which provides a cover for edges of dissimilar surfaces. For example, when installing floors into a home, the assembly could be used to provide an edge between a hallway and a bedroom, between a kitchen and living or bathroom, or any areas where distinct flooring is desired. Additionally, the assembly may be incorporated into differing types of flooring, such as wood, tile, linoleum, carpet, or turf.

The invention also is drawn to an inventive method for covering a gap between adjacent panels of a generally planar surface. The method includes multiple steps, including, inter alia, placing the foot in the gap, pressing the respective arms into contact with the respective floor elements, and configuring at least one of the tab and the foot to cooperate to retain the assembly in the gap after the assembly has been installed.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
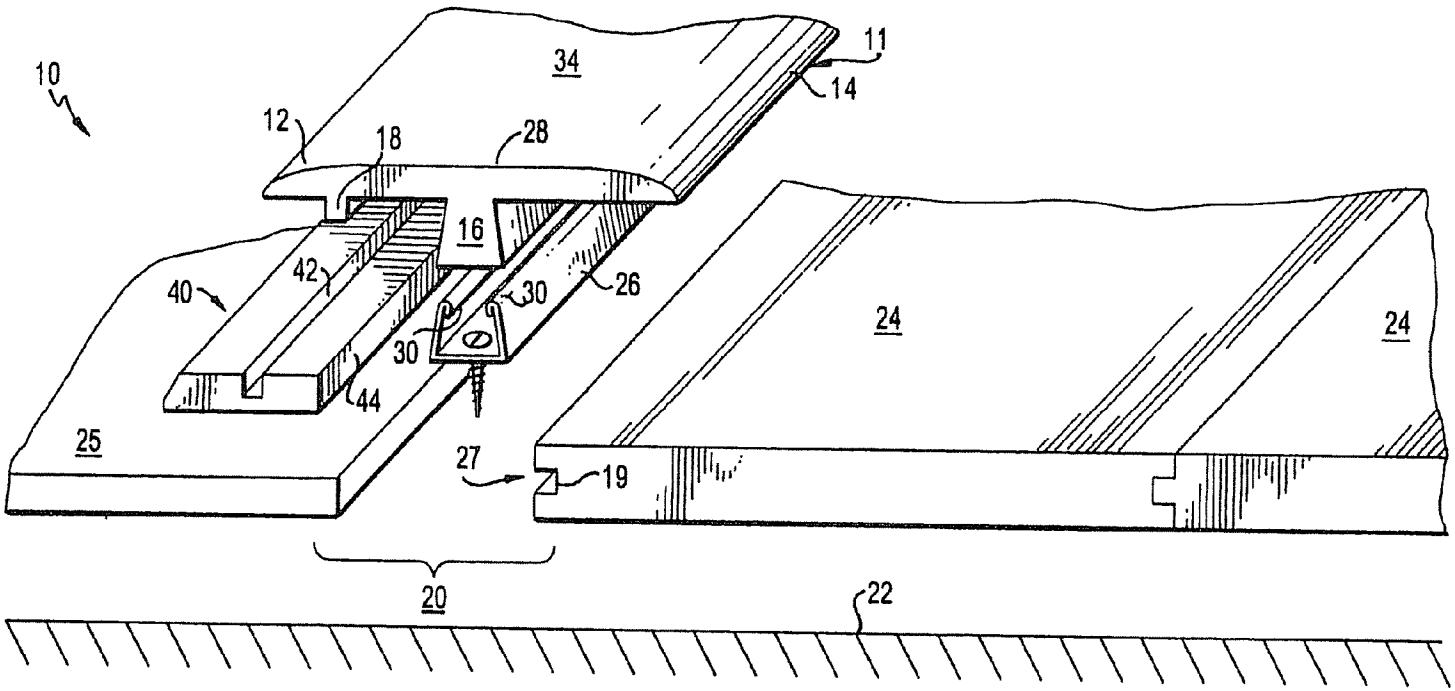
FIG. 1 is an exploded view of an embodiment of the joint cover assembly in accordance with the invention.

FIG. 1 shows an exploded view of the various parts of the inventive joint cover assembly 10. The assembly 10 includes a T-shaped molding 11, having an foot 16 formed so that it can fit in a gap 20 between adjacent floor elements 24, 25. FIG. 1 demonstrates a typical use, in which the gap 20 is formed adjacent an edge 27 of a floor element 24. Although FIG. 1, depicts all of the floor elements 24 to be conventional tongue-and-groove type floor panels (having a groove 27 positioned adjacent to the gap 20), this is merely one of any number of embodiments. For example, floor elements 24, need not be the same type of floor element. Specifically, the floor elements 24 can be any type of flooring designed to used as a floor or placed over a subfloor 22, e.g., tile, linoleum, laminate flooring, concrete slab, parquet, vinyl, turf, composite or hardwood. As is known, laminate floors are not attached to the subfloor 22, but are considered "floating floors".

The molding 11 is provided with a first arm 12 and a second arm 14 extending in a single plane generally perpendicular to the foot 16. Preferably, the foot 16, first arm 12, and the second arm 14 from a general T-shape, with the arms 12 and 14 forming the upper structure and the foot 16 forming the lower structure.

The molding 11, as well as any of the other components used in the invention, may be formed of any suitable, sturdy material, such as wood, polymer, or even a wood/polymer composite. Due to the growing popularity of wood and laminate flooring and wood wall paneling, however, a natural or simulated wood-grain appearance may be provided as the outward facing surface 34 of the molding 11. The outward facing surface 34 may be a conventional laminate, such as a high pressure laminate (HPL), direct laminate (DL) or a post-formed laminate (as described in U.S. application Ser. No. 08/817,391, herein incorporated by reference in its entirety); a foil; a print, such as a photograph or a digitally generated image; or a liquid coating including, for example, aluminum oxide. Thus, in the event natural wood or wood veneer is not selected as the material, the appearance of wood may be simulated by coating the outer surface 34 with a laminate having a decor sheet that simulates wood. Alternatively, the decor can simulate stone, brick, inlays, or even fantasy patterns. Preferably, the outward facing surface 34 extends completely across the upper face of the molding, and optionally over under surface 36 and 38 of arms 12 and 14, respectively.

The core structure of components of the invention, including the center of the molding 11, that is in contact with the outward facing surface 34 is formed from a core material. Typical core materials include wood based products, such as high density fiberboard (HDF), medium density fiberboard (MDF), particleboard, strandboard, and solid wood; plastic-based products, such as polyvinyl chloride (PVC), thermal plastics or mixtures of plastic and other products; and metals, such as aluminum, stainless steel, or copper. The various components of the invention are preferably constructed in accordance with the methods disclosed by U.S. application Ser. No. 08/817,391, as well as U.S. application Ser. No. 10/319,820, filed Dec. 16, 2002, each of which is herein incorporated by reference in its entirety.

Figure 1B:
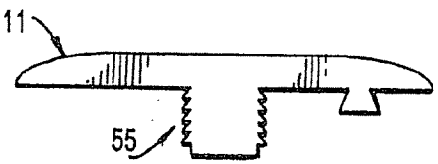
FIGS. 1A and 1B are alternate embodiments for the molding of the invention.

A securing means, such as a metal clamp 26, may be coupled to the subfloor 22 within the gap 20 formed between the two floor elements 24 and 25. The clamp may be coupled to the subfloor 22 by fasteners, such as screws or any conventional coupling method, such as nails or glue. The clamp 26 and the foot 16 are preferably cooperatively formed so that the foot 16 can slide within the clamp 26 without being removed. For example, the clamp 26 may be provided with in-turned ends 30 designed to grab the outer surface of the foot 16. Typically, the foot 16 has a dove-tail shape, having the shorter parallel edge joined to the arms 12 and 14; and the clamp 26 is a wire element having a corresponding shape as to mate with the foot 16 and hold it in place. Additionally, the securing element may take the form of an inverted T-element 50 (FIG. 1A), configured to mate with a corresponding groove 52 in an end of foot 16, such that friction between the T-element 50 and the groove 52 secures the molding 11 in place, or, in the alternative, the end of the foot 16 may be provided with a narrowed section, designed to mate with a groove in the securing element. Finally, each of the T-element 50, mating section of the foot 16 and/or various grooves, may be provided with notched or barbed edges 55 to simultaneously assist in mating and resist disassembly (FIG. 1B). However, in an alternative embodiment, the securing element can be eliminated because the molding 11 can be affixed to one of the floor elements 24, 25, by, for example, an adhesive. Preferably however, the molding 11 is not secured to both floor elements 24, 25, as to permit a degree of relative movement, or floating, between the floor elements 24, 25.

The clamp 26 may additionally be formed of a sturdy, yet pliable material that will outwardly deform as the foot 16 is inserted, but will retain the foot 16 therein. Such materials include, but are not limited to, plastic, wood/polymer composites, wood, and polymers.

Figure 1A:
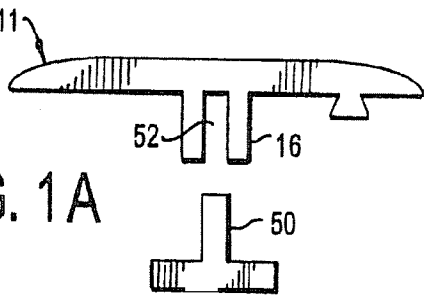

A tab 18 is shown as extending downwardly from the first arm 12. As shown in FIG. 1, the tab 18 extends downward, or away from an outward facing surface 34 of the molding, and runs generally parallel to the foot 16. As shown in FIG. 1A, the tab 18 may also be in the shape of a dove-tail with a shorter edge adjacent to the first arm 12; however, other suitable shapes are possible. The shape of the outwardly facing surface 34 of the molding 11 is shown as being convex in some of the Figures (e.g., FIGS. 1A, 1B and 7), and substantially planar in others (e.g., FIGS. 1, 2, 4, and 6). When the outwardly facing surface 34 is substantially planar, the edges of the molding 11 may either be upright or at an angle, typically angling away from the foot 16.

The assembly may further include a leveling block 40. When flooring elements 24 and 25 are of differing heights, the leveling block 40 is positioned between either the first arm 12 or the second arm 14 and the subfloor 22. Preferably, the size of the leveling block 40 is selected to correspond essentially to the difference in heights of the two flooring elements 24 and 25. For example, if one flooring element 24 is a ceramic tile, having a thickness of 2" and the second flooring element 25 is linoleum, having a thickness of ¼", the leveling block 40 would typically have a thickness of 1¾" to bridge the difference and be placed between arm 12 and the other flooring element 25. Without the leveling block 40, a significant space would exist between the second flooring element 25 and the molding 11, allowing for moisture and dirt to accumulate. While the difference in heights of the flooring elements 24, 25 is generally caused by a difference in thickness between the two flooring elements 24, 25, the present invention may also be used to "flatten out" an uneven subfloor 22. In a preferred embodiment, the leveling block is provided with a channel 42 designed to receive the tab 18.

Figure 6:
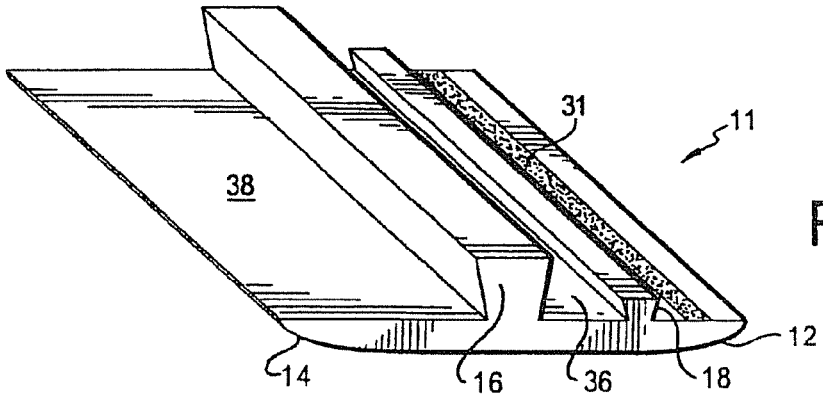
FIGS. 6-16 show comparative cross-sectional views of various embodiments of the molding portion of the joint cover assembly.

Even though the assembly 10 may function without any type of glue or adhesive, an alternate embodiment includes the placement of adhesive 31 on the molding 11. The adhesive may be placed on molding 11 at the factory (for example, pre-glued). Alternatively, the glue may be applied while the floor elements 24, 25 are being assembled. As shown in FIG. 6, the adhesive 31 may be provided as a strip-type adhesive, but any type of adhesive, such as glue, chemical or chemically-activated adhesive, water-activated adhesive, contact cements, microballoon adhesive may be used. Additionally, while the embodiment in FIG. 6 shows a single adhesive strip 31 attached to the arm 12, the adhesive 31 may be attached to the tab 18, foot 16, and/or any location where two pieces of the assembly are joined. Preferably, adhesive 31 is only applied to one of the arms 12, 14 in order to allow accommodate some slight relative movement that may occur during changes of temperature, for example. This relative movement is known in the flooring art as "float". Allowing float may also eliminate unneeded material stresses as well, thereby reducing warping or deterioration of the material surface. Typical adhesives used in the invention include a fresh adhesive, such as PERGO GLUE (available from Perstorp AS of Perstorp, Sweden), water activated dry glue, dry glue (needing no activation) or an adhesive strip with a peel off protector of paper.

Figure 2:
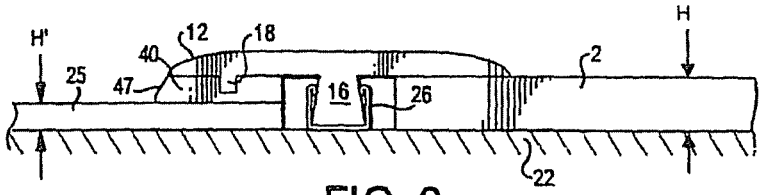
FIG. 2 is a perspective view of a second embodiment of the joint cover assembly in accordance with the invention.
Figure 3:
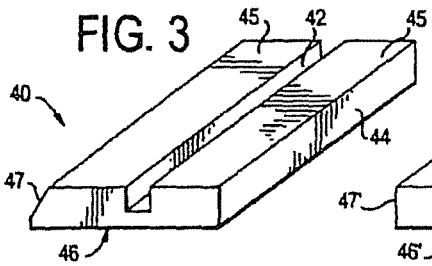
FIGS. 3 and 3A are a comparative perspective views of embodiments of the leveling block.

FIG. 2 shows a typical embodiment of the assembly 10 in an installed condition, wherein the floor elements 24 and 25 are of differing thicknesses (H and H' respectively). Of course, the element 24 may be of any type of covering, such as carpet, turf, tile, linoleum or the like. As shown in FIG. 3, the leveling block 40 typically includes a substantially flat bottom 46, and a top 45 having a channel 42, and an inner surface 44. The top 45 of the leveling block 40 is designed to firmly abut the under surface 36 of the first arm 12, while the bottom 46 abuts floor element 25. Typically, the channel 42 is shaped as to firmly hold the tab 18. The inner surface 44 of the leveling block 40 need not abut the foot, as generally, a small amount of clearance is provided between the clamp 26 or foot 16 and the inner surface 44 of the leveling block. However, the inner surface 44 may configured to contact either of the clamp 26 or foot 16.

The leveling block 40 may be made of a composite, pliable material that is also resilient. For example, the tab 18 may be formed to be slightly larger than the opening of the channel 42, thereby forcing the channel 42 to outwardly deform in order to accommodate the tab 18, and therefore snap-fit together.

As shown in FIG. 3, the outer surface 47 of the leveling block 40 is generally treated to match or blend with the outer surface 34 of the molding or the floor element 24, 25 in order to improve aesthetics.

Figure 3A:
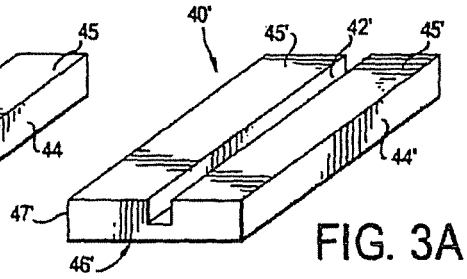

FIG. 3A shows an alternate embodiment of a leveling block 40'. An outer surface 47' of this embodiment is configured generally perpendicular to an upper surface 44' and a lower surface 46' of the leveling block 40'. This alternate configuration of the outer surface 47' not only provides a different appearance, it also has been shown to be preferred when softer surfaces, such as carpet or turf, are positioned beneath the lower surface 46' of the leveling block 40'.

Figure 4:
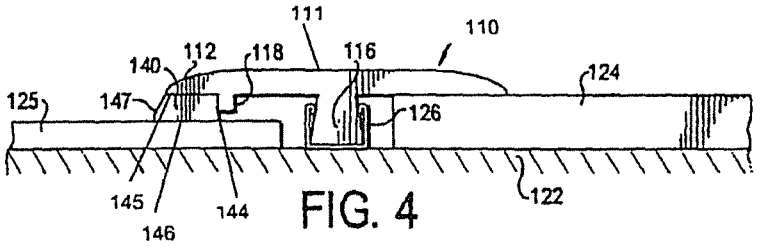
FIG. 4 is perspective view of an additional embodiment of the joint cover assembly in accordance with the invention.

FIG. 4 shows yet another alternate embodiment of the leveling block 140. The leveling block 140 includes a bottom 146, and a top 145 and an inner surface 144. The top 145 of the leveling block 140 is designed to firmly abut the under surface 36 of the first arm 112, while the bottom 146 abuts floor element 125. This leveling block 140 is positioned between a first arm 112 of the molding 111 and the flooring element 125. In this embodiment of the assembly 110, the tab 118 engages the inner surface 144 of the leveling block 140.

Figure 5:
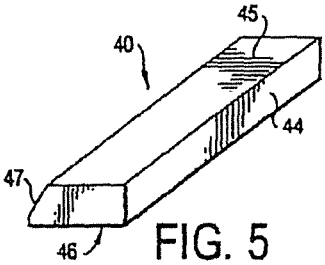
FIGS. 5 and 5A are a comparative perspective views of embodiments of the leveling block.

FIG. 5 shows an embodiment of a leveling block 40 that may be used in the assembly shown in FIG. 4. Specifically, the leveling block 40 in FIG. 5 has a solid, uninterrupted upper surface 45, without the need for a channel because the tab (118, as in FIG. 4) will engage the inner surface 44 of the leveling block of instead of the top surface 45.

Figure 5A:
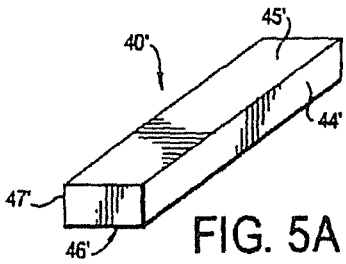

FIG. 5A shows an additional shape of a leveling block 140' that can be incorporated into the assembly shown in FIG. 4. Leveling block 40' has a front surface 46' that will be generally perpendicular to a floor 122 (as shown in FIG. 4) when the leveling block 40' is installed. This perpendicular configuration of the front surface 47' not only provides a different appearance, it has also been found to be preferred with softer surfaces, such as carpet or turf.

FIG. 6 shows an underside view of the molding 11. In particular the first under surface 36 of the first arm 12, and the second under surface 38 of the second arm 14 are shown. In one embodiment, under surface 36 is provided with the adhesive 31 positioned to adhere to a surface of a floor element 24, 25 or leveling block 40,40', 140,140'.

FIGS. 7-15 show various cross-sectional views of the molding 11. These figures show comparative configurations for the arms 12, 14, the tab 18, and the shape of molding 11.

Figure 7:
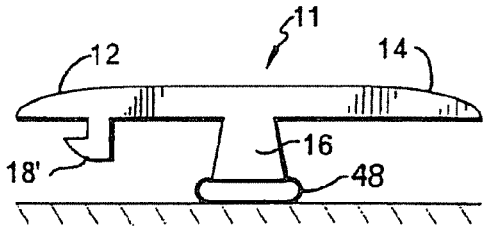
Figure 8:
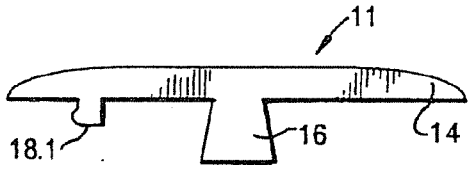

In FIG. 7, the tab 18 is selected to be an outward-facing hook having a barb facing away from the foot 16, while the upper surface of the molding has a convex curvature. This particular selection for the tab 18 may be used to engage an edge or groove of an adjacent floor element 24, 25, or in the alternative, an adjacent leveling block 40. Additionally, a shim 48 may be positioned between the foot 16 and the subfloor 22. The shim 48 is generally a pliable and flexible, yet durable material. The shim 48 may be used in place of, or in combination with, clamp 26.

Figure 9:
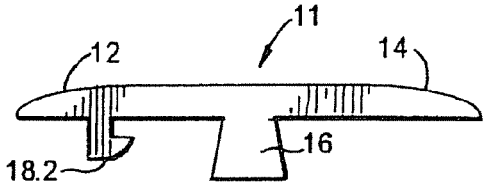
Figure 10:
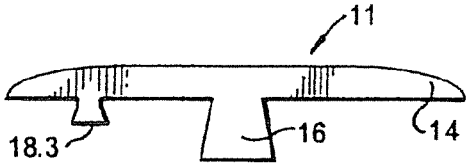
Figure 11:
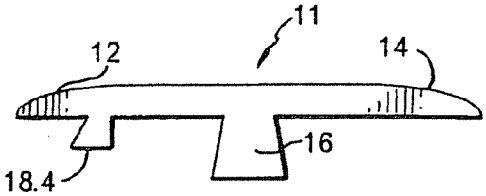
Figure 12:
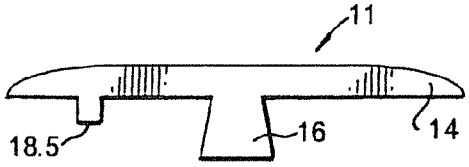
Figure 13:
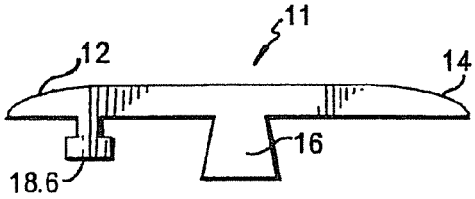
Figure 14:
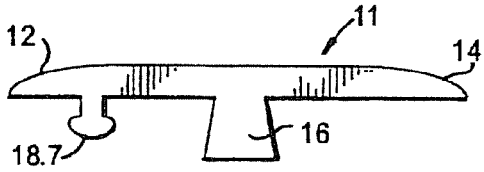
Figure 15:
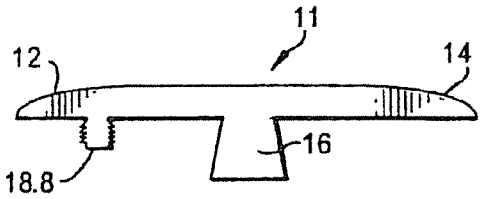

FIGS. 8-15 show cross-sections of other shapes for the molding 11. The configurations of the moldings are very similar, except for the shape of the tab 18. The differing tabs have been assigned decimal numbers beginning with 18.1, for clarity purposes. A tab 18.1 (FIG. 8) is a bulbous shape, having its rounded end furthest from the arm 12. A tab 18.2 of FIG. 9 is provided with a hook-shape with a point facing the foot 16. In the embodiment shown in FIG. 10, a tab 18.3 is in the shape of a dove-tail, similar to the shape of the tab 18 shown in FIG. 17.

The purpose of the various-shaped tabs (18-18.8) is multifold. Primarily, the tab 18 serves to engage the channel 42 of the leveling block 40, which is used when covering of differing thickness is used. Alternatively, the respective tab (18-18.8) may engage an edge of a panel, carpet, turf, or other type of floor covering. As shown herein, the respective tab (18-18.8) may even be configured to engage a leveling block.

It is additionally considered within the scope of the invention to eliminate the tab. In such an embodiment, preferably, the molding 11 includes an adhesive on the under surface 36, 380 f one of the arms 12, 14.

Figure 16:
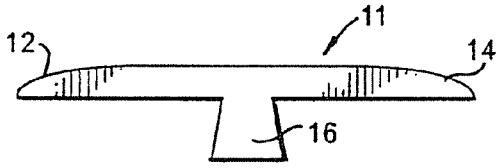

With respect to FIG. 16, the invention may also be used when the floor elements are not co-planar. For example, one embodiment includes a stair nose attachment 210 that can be attached to the same molding 11, as described above. As used herein, a stair nose attachment is a component capable of mating with the molding 11 as to conceal, protect or otherwise cover a joint forming a single stair. Typically, the molding 11 is provided atop the first floor element 24 on the horizontal, or run 220 of the stair, such that the stair nose attachment 210 bridges the joint between the first floor element 24 and the second floor element 25, forming the vertical section of the stair, or rise 230. As a result, the invention can be used to cover and protect joints between flooring elements on stairs. While in a preferred embodiment, the floor elements covering the rise 220 and run 230 are the same type of flooring material, the flooring elements need not be of the same construction.

The stair nose attachment 210 may include a tab receiving groove 212, permitting connection of the stair nose attachment 210 to the molding 11. Because the tab receiving groove 212 in the stair nose attachment 210 is preferably shaped according to the shape of the tab 18 of the molding 11, the stair nose attachment 210 may be attached to the molding 11 by, for example, snapping or sliding.

However, in other embodiments, the tab on the under surface 36 of first arm 12 is eliminated. While the tabs and corresponding grooves may be eliminated, it is nevertheless considered within the scope of the invention to utilize an adhesive, as described herein. Alternatively, the stair nose attachment 210 may include a tab 218 to mate with a corresponding groove 219 on the foot 16 of the molding 11 (FIG. 18), or vice-versa.

Figure 17:
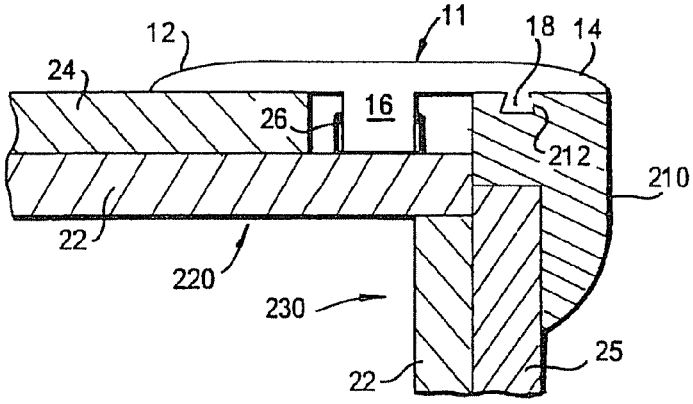
FIG. 17 depicts an embodiment of the assembly of the invention for use with stairs.

Additionally, an adhesive, as described herein, may be applied to any component in order to secure the connection between the molding 11 and the stair nose attachment 210. Although FIG. 17 shows tab 18 (and accordingly the tab receiving groove 212) as having a dove-tail shape, it is considered within the scope of the invention to vary the particular shape of the tab 18 and tab receiving groove 212. For example, the shapes may be bulbous, or slide tongue to matching groove, or any other configuration described herein.

Figure 18:
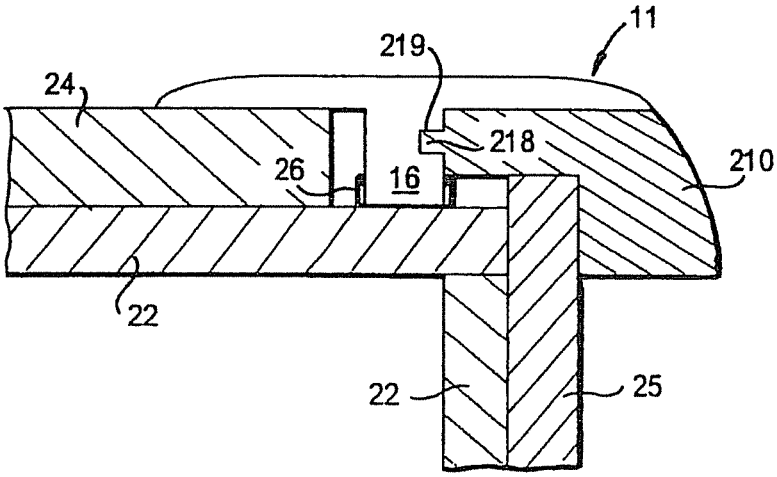
FIG. 18 shows a second embodiment of the assembly for use with stairs.
Figure 19:
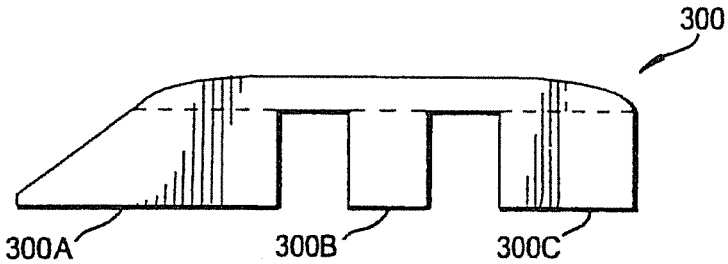
FIG. 19 is a side view of a generic element, which may be broken into the components of the invention.
Figure 21:
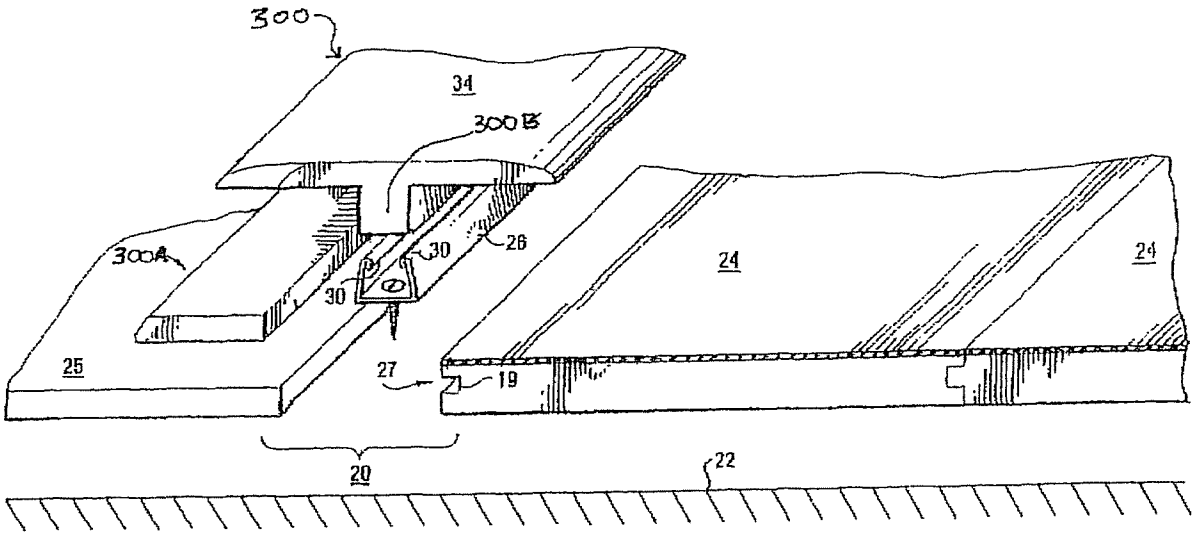
FIG. 21 shows the generic element of FIG. 20 in use with other components 24, 24 to form a flooring surface.
Figure 20:
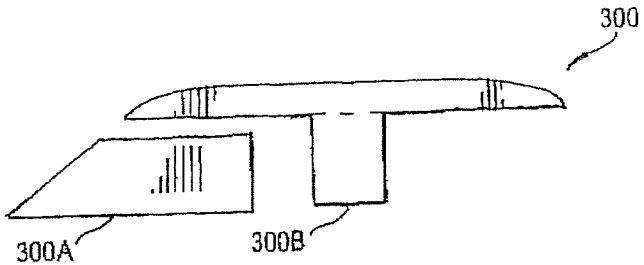
FIG. 20 is a side view of the generic element of FIG. 19 with leveling block 300A separated and with portion 300C removed.

It is also possible to form the molding 11, leveling block 40 and stair nose attachment 210 from the same element, as shown in FIG. 18. Specifically, a generic element, indicated at 300 can be milled, sawed or otherwise constructed with a variety of "break away" sections 300A, 3008, and 300C. When one or more break away sections 300A, 3008, 300C are removed, by for example, scoring and snapping, cutting, sawing or simply bending, the individual pieces can result. Preferably, the generic element 300 is formed as a unitary structure which is then scored as to provide stress-points to allow the removal of the break-away sections. While not required by the present invention, typically, the removal of the break-away sections 300A, 3008, 300C requires a significant amount of physical force or labor, as the remaining structure must maintain its structural integrity. Alternatively, removal of the break-away sections 300A, 3008, 300C may require the use of a specialized tool.

By designing the generic element 300 in accordance with the invention. An installer can manipulate the generic element 300 to produce any needed component. For example, removing sections 3008 and 300C would produce a typical stair nose attachment 210, while removing sections 300A and 300C would produce a typical molding 11. Due to this construction, it is possible to manufacture the generic elements to be purchased and appropriately broken down by the installer. Similarly, when removing sections 300A and 300C to form the molding 11, section 300A can be used as a leveling block as described herein.

By allowing an end user to purchase the generic element 300 instead of separate components, the retailers and/or distributors may accordingly reduce their inventory requirements. For example, typically over one-hundred different design patterns for the outwardly facing surface 34 of the molding 11 (as well as for the leveling block 40 and stair nose attachment 210) are produced. By allowing for the inventory to include only the generic elements of the invention, the total number of components retained can be reduced from three per design to one per design. Similarly, the installer only need purchase the generic elements 300, rather than three individual components.

It should be apparent that embodiments other than those specifically described above may come within the spirit and scope of the present invention. Hence, the present invention is not limited by the above description.

What is claimed is:

1. A joint cover assembly for covering a gap between two floor elements, the assembly comprising:

a molding, comprising:

a foot positioned along a longitudinal axis and having a lower surface;

a first arm extending generally perpendicularly from the foot; and a second arm extending generally perpendicularly from the foot; and a leveling block having a lower surface;

wherein the first arm of the molding and the leveling block comprise engaging members configured for coupling the leveling block to the molding, wherein an outwardly facing surface of the leveling block is adjacent to an outwardly facing surface of the first arm, wherein the outwardly facing surfaces of the leveling block and first arm have a wood grain appearance, wherein the lower surface of the leveling block, when engaged to the molding, is substantially at the same level or below the lower surface of the foot.

2. The joint cover assembly of claim 1, wherein the engaging members comprise a tongue and a groove for receiving the tongue.

3. The joint cover assembly of claim 2, wherein the tongue is on the leveling block and the groove is on the molding.

4. The joint cover assembly of claim 3, wherein the groove is on an arm of the molding.

5. The joint cover assembly of claim 1, wherein the engaging members comprise a tab and a slot for receiving the tab.

6. The joint cover assembly of claim 5, wherein the tab is on the leveling block and the slot is on the molding.

7. The joint cover assembly of claim 6, wherein the slot is on an arm of the molding.

8. The joint cover assembly of claim 1, wherein the molding and the leveling block cooperate to retain the joint cover assembly in a gap between two floor elements when the assembly is in an installed condition.

9. The joint cover assembly of claim 1, wherein a clearance is provided between an arm of the molding and the leveling block.

10. A joint cover assembly for covering a gap between two floor elements, the assembly comprising:

a molding, comprising:

a foot positioned along a longitudinal axis and having a lower surface;

a first arm extending generally perpendicularly from the foot; and a second arm extending generally perpendicularly from the foot; and a leveling block having a lower surface;

wherein the first arm of the molding and the leveling block comprise engaging members configured for coupling the leveling block to the molding, wherein an outwardly facing surface of the leveling block is flush with an outwardly facing surface of the first arm, wherein the outwardly facing surfaces of the leveling block and first arm have a wood grain appearance, wherein the lower surface of the leveling block, when engaged to the molding, is substantially at the same level or below the lower surface of the foot.

11. The joint cover assembly for claim 10, wherein the outwardly facing surfaces of the leveling block and first arm are treated with a paper or laminate with a wood grain appearance.

* * * * *